United States Patent [19]

Thoenig et al.

[11] 4,364,669

[45] Dec. 21, 1982

[54] CHRONOGRAPHIC WATCH

[75] Inventors: Marcel Thoenig, Granges; Jean-Pierre Wattenhofer, Neuchatel, both of Switzerland

[73] Assignee: Ebauches, S.A., Switzerland

[21] Appl. No.: 226,182

[22] Filed: Jan. 19, 1981

[30] Foreign Application Priority Data

Jan. 21, 1980 [CH] Switzerland ..... 437/80

[51] Int. Cl.[3] ..... G04F 10/00; G04B 19/04

[52] U.S. Cl. ..... 368/111; 368/80; 368/102

[58] Field of Search ..... 368/76, 80, 102, 107, 368/108, 111, 112, 113

[56] References Cited

U.S. PATENT DOCUMENTS

| | | | |
|---|---|---|---|
| 3,662,535 | 5/1972 | Hedrick et al. | 368/112 |
| 4,211,066 | 7/1980 | Kusumoto et al. | 368/113 |
| 4,212,158 | 7/1980 | Tamaru | 368/80 |

*Primary Examiner*—J. V. Truhe
*Assistant Examiner*—Forester W. Isen
*Attorney, Agent, or Firm*—Allegretti, Newitt, Witcoff & McAndrews, Ltd.

[57] ABSTRACT

The watch, as exemplified by FIG. 6, comprises a motor 9 which drives the hands of a timepiece mechanism and a motor 15 which advances those of a chronographic mechanism. When the timepiece mechanism is in operation, a counter 98 receives every six seconds a pulse which opens a gate 85 which passes a pulse of 32 Hz and causes the shaft of the motor 9 to advance one step. When the stopwatch mechanism is in operation, a counter 78 receives ten pulses per second; every ten pulses it sends a pulse to the motor 15 and drives the chronographic second hand. When the chronographic mechanism is stopped, this second hand shows the seconds of chronometric time, the supplementary tenths of seconds being stored in the counter 78. The state of this counter 78 is compared with the state of an UP-DOWN counter 86 which determines the position of the second hand of the timepiece mechanism. The motor 9 then receives a number of pulses of 32 Hz equal to the numerical difference between the state of the counter 78 and that of the UP-DOWN counter 86. These pulses cause the tenths of a second over and above the last second of the chronometrically measured time, to be indicated by the second hand of the timepiece mechanism.

14 Claims, 8 Drawing Figures

CHRONOGRAPHIC WATCH

BACKGROUND OF THE INVENTION

The present invention relates to a chronographic watch comprising a timepiece mechanism and a stopwatch mechanism, which respectively indicate absolute time, and effect the measurement of more or less short intervals of time. Two different kinds of such watches exist: chronographic watches with digital display and those with analogue display. Electronic digital watches have the advantage that they comprise, in addition to the timepiece mechanism and counters which merely count seconds, minutes and hours, recall systems that enable simultaneous events to be timed. Such watches can readily be provided with a wide variety of functions which can be achieved by electronic counting circuits but which would be difficult to achieve by mechanical means.

Analogue chronographic watches have the advantages of all analogue timepieces, that is to say the rapidity with which elapsed time and time to go can be determined; these advantages are appreciated in certain professions and among those responsible for deciding the results of sporting events. They also have the elegance and aesthetic appearance of watches provided with dial and hands.

It would obviously be possible to motorize a mechanical chronographic watch with the aid of a conventional electric motor. This solution, which is not very elegant, would necessitate the use of a motor with a shaft which advances at the rate of ten steps per second, which would involve a high consumption of energy, even when the chronographic mechanism is stopped. Moreover, certain advantages of exclusively electronic devices could not be retained. It would also be possible to envisage the super-imposition of a watch and a counter one upon the other, each of them having its own independent driving means. This complicated and not very elegant construction would not enable this watch to be produced as a commercial product.

BRIEF SUMMARY OF THE INVENTION

The object of the present invention is to provide an electronic chronographic watch which has conventional indicating means in the form of hands and which has the above-mentioned advantages of digital watches. According to the present invention, in one advantageous embodiment there is provided a chronographic watch comprising a timepiece mechanism and a stopwatch mechanism. These mchanisms comprise a first set of gear-driven hands for indicating the hour, minute and second, a second set of gear-driven hands for indicating the chronometric hour, the chronometric minute and the chronometric second. In addition there is a frequency source delivering a low frequency signal, an intermediate frequency signal and a high frequency signal; a first motor supplied with the low frequency signal and driving the first set of hands so they perform the function of timepiece hands; a second motor driving the second set of hands; a circuit including means responsive to an external operation to start and stop the stopwatch mechanism by supplying, and ceasing to supply, the second motor with pulses at the intermediate frequency; means for storing the fraction of a second of chronometric time in excess of the time indicated by the second hand of the second set of hands, and control means responsive to the stopping of the stopwatch mechanism for supplying to the first motor a number of pulses of the high frequency corresponding to the fraction in such a manner that the fraction will be indicated by means of the second hand of the first set of hands; and means for resetting the second set of hands to zero in response to an external operation.

BRIEF DESCRIPTION OF THE DRAWINGS

One embodiment of the chronographic watch according to the invention is illustrated in the accompanying drawings, in which.

DETAILED DESCRIPTION OF THE PREFERRED EMBODIMENT

Figure 1:
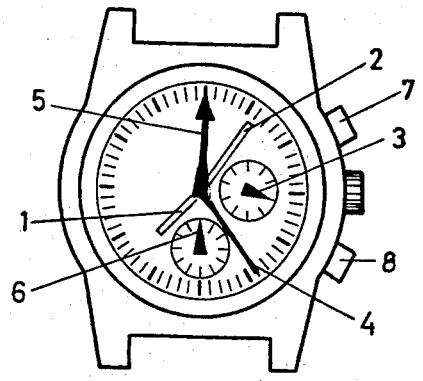
FIG. 1 is a front view of the watch.

The watch shown in FIG. 1 comprises an hour hand 1, a minute hand 2, a small second hand 3 which will also serve as a hand for indicating tenths of a second of chronometric time, a hand 4 for indicating seconds of chronometric time, a hand 5 for indicating minutes of chronometric time and a hand 6 for indicating hours of chronometric time. It also comprises a START/STOP push button 7 and a reset-to-zero and recall push button 8.

Figure 2:
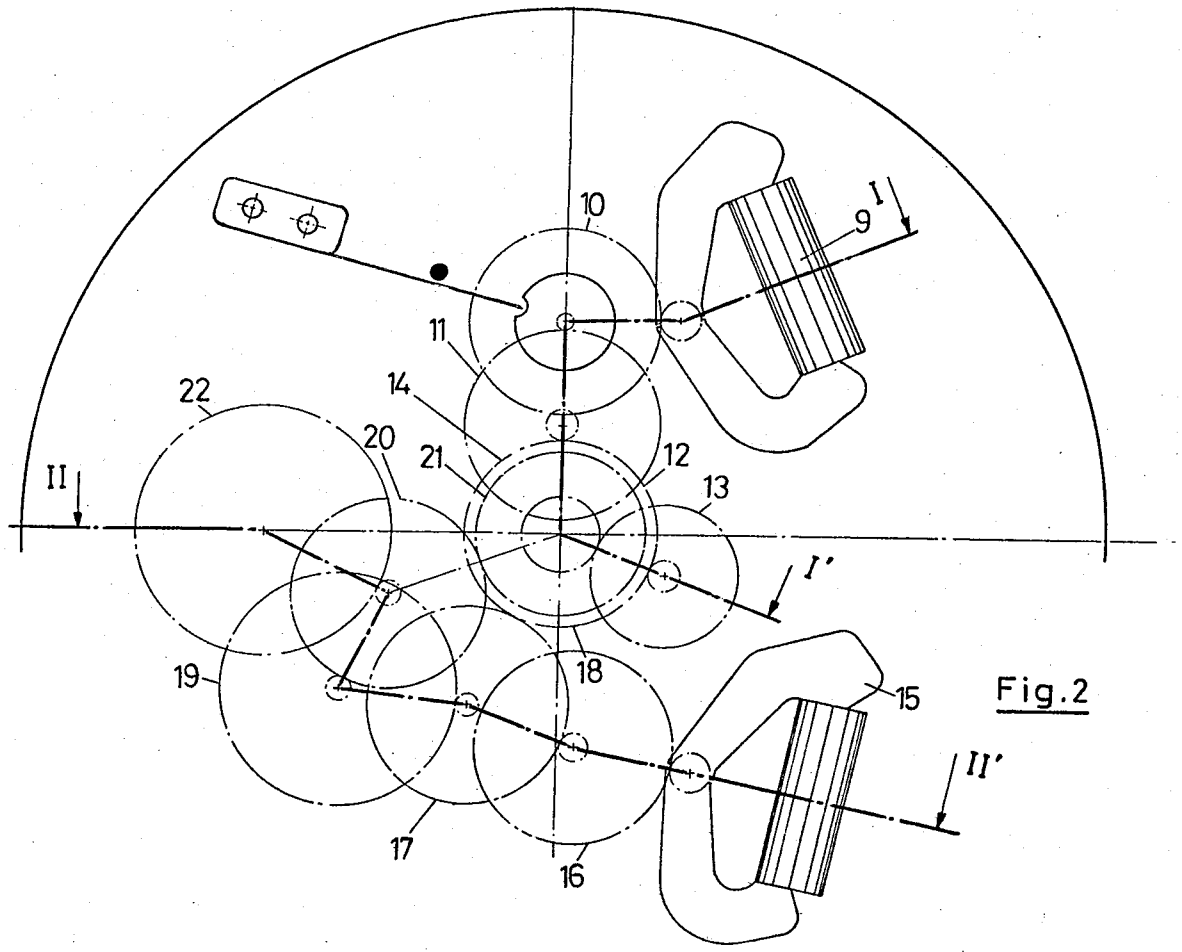
FIG. 2 is a plan view of the gear trains of the watch.
Figure 3:
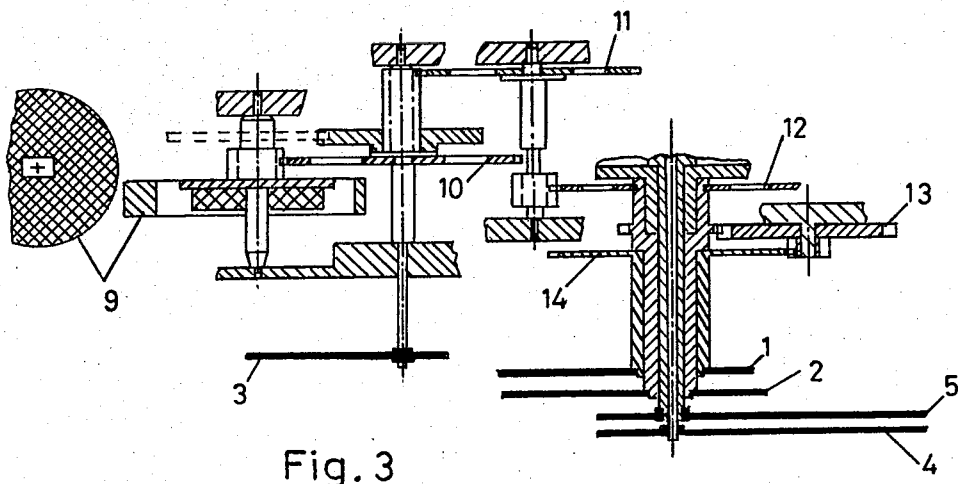
FIG. 3 is a section, taken on the line I-I' of FIG. 2, illustrating the going train.
Figure 4:
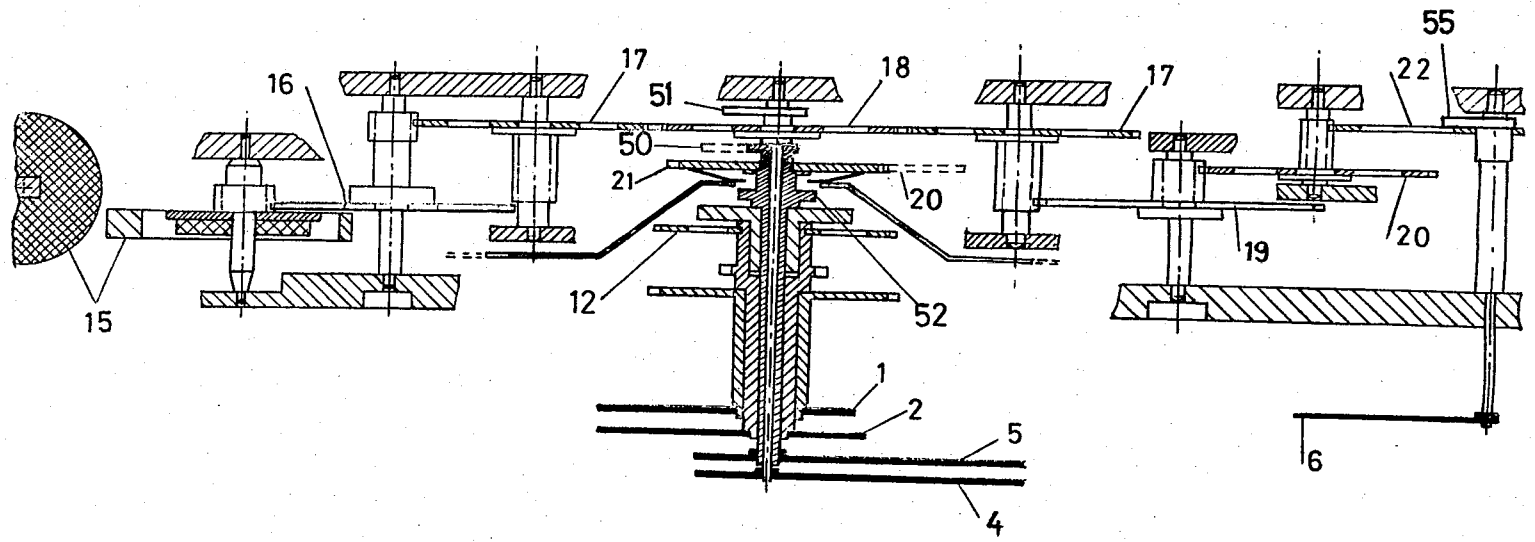
FIG. 4 is a section, taken on the line II-II' in FIG. 2, illustrating the chronographic train.

The movement of the watch, which is shown in FIGS. 2, 3, and 4, comprises a timepiece stepping motor 9 which drives an intermediate wheel 10 which carries the small second hand 3. This intermediate wheel 10 has a pinion which drives a second intermediate wheel 11 with a pinion which meshes with a minute wheel 12 carrying the minute hand 2. The minute wheel 12 has a pinion which meshes with a wheel 13 with a pinion which drives an hour wheel 14 carrying the hour hand 1.

The motor 15 of the chronographic mechanism drives an intermediate wheel 16 which, in turn, drives an intermediate wheel 17 (FIGS. 2 and 4). This second intermediate wheel 17 meshes with a chronographic second wheel 18 carrying the chronographic second hand 4. The wheels 12, 14 and 18 all have the same diameter and appear as one circle in FIG. 2. The second intermediate wheel 17, which is shown twice in FIG. 4, (because the section line II-II' extends from the axis of the wheel 17 to the axis of the wheel 18 and back again), also has a pinion which meshes with a third intermediate wheel 19 with a pinion which meshes with a fourth intermediate wheel 20. This fourth intermediate wheel 20 drives a chronographic minute wheel 21, which carries the chronographic minute hand 5, and also has a pinion which drives a chronographic hour wheel 22 carries the chronographic hour hand 6.

Figure 5:
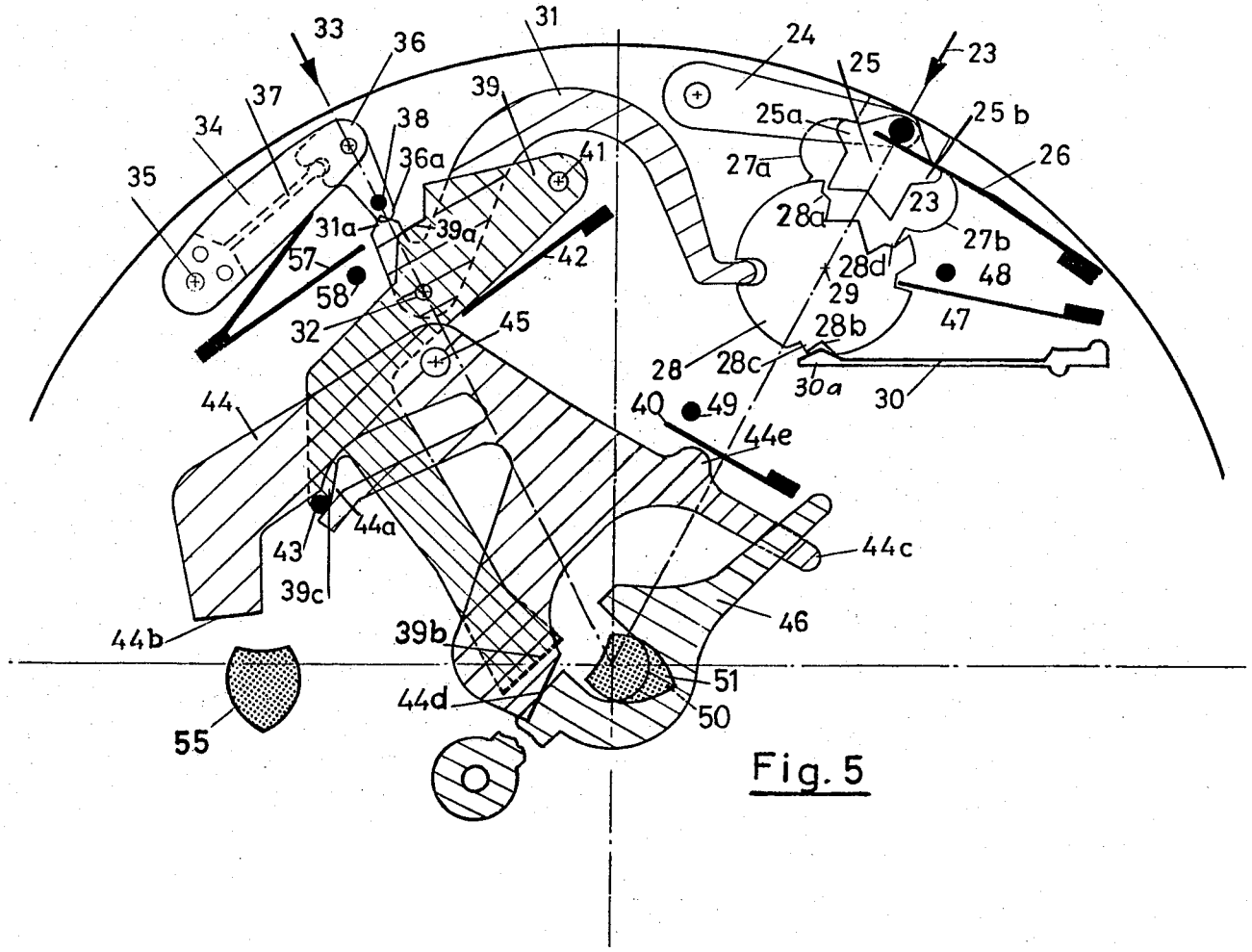
FIG. 5 illustrates diagrammatically the chronographic mechanism.

The chronographic mechanism shown in FIG. 5 is known per se. The push button 7, indicated schematically by an arrow 23, acts on a pivoted arm 24 which carries a pivoted double pawl 25. The pivoted arm is urged back towards the periphery of the watch by a spring 26. The pawl 25 is positioned between two shoulders 27*a* and 27*b* of a plate, the lugs 25*a* and 25*b* of the pawl act against these shoulders to centralize the pawl when it is retracted. The pawl 25 operates a cam 28 which is rotatable about an axis 29. This cam has two stable portions determined by engagement of the end part 30*a* of a detent spring 30 in one or other of two notches 28*b* and 28*c* in the cam. The cam 28 drives a selector lever 31 which is pivoted at 32.

The return-to-zero resetting plunger 8 is indicated in FIG. 5 by an arrow 33. This plunger acts against an arm 34 which is pivoted at 35 and carries a pivoted member 36 positioned by a spring 37. The pivoted member 36 carries a pin 38 which cooperates with an end part 31*a* of the selector lever 31. The end part 36*a* of the pivoted member 36 cooperates, according to the position of the selector lever 31, either with a straight edge 39*a* of a rocking plate 39 or with a contact spring 57. The rocking plate 39 is pivoted at 41 and is held in position by a spring 42. An end part 39*b* of this rocking plate is arranged to cooperate, as will be described later, with a member 50 fixed for rotation with the minute wheel 12. A further end part 39*c* of the same rocking plate 39 carries a pin 43 which engages in a slot 44*a* in a rocking plate 44, pivoted at 45. The plate 44 cooperates on the one hand by means of an end part 44*b*; as will be described later, with a member 55 fixed for rotation with the hour wheel and on the other hand by means of an end part 44*c* with a clutch spring 46.

The mechanical operation of the illustrated watch is as follows:

When the chronographic mechanism is disengaged, only the motor 9 is in operation, the shaft thereof rotating at a rate of ten steps per minute. During each minute the wheel 10 carrying the small second hand 3 accordingly performs one revolution and the minute hand 2 travels over a 6 degree sector. To start the stopwatch, the user depresses the push button 7 indicated in FIG. 5 by the arrow 23. This push button acts on the pivoted arm 24 so that the pawl 25 engages the cam 28 and 28*a* and causes this cam 28 to rotate, so that the end 30*a* of the spring 30 is dislodged from the notch 28*b* and engaged in the notch 28*c*. This rotation produces two effects: on the one hand it closes a switch, the function of which will be explained later, by moving a leaf spring 47 into contact with a pin 48, and on the other hand it causes the selector lever 31 to pivot. The position of this selector lever 31 is now such that, if the user depresses the push button 8, indicated by the arrow 33 in FIG. 5, the pin 38 will bear against the left-hand flank of the end part 31*a* of the selector lever 31 and be deflected across the plate edge 39*a*. Thus, accidental resetting to zero cannot take place during the time measuring operation.

When the user depresses the push button 7 a second time, the pawl 25 engages the part 28*d* of the cam 28. As a result, the spring 47 is disengaged from the contact 48 and the end part 30*a* of the spring 30 is disengaged from the notch 28*c* and engages in the notch 28*b*. Furthermore, the selector lever 31 is displaced so that, if the user depresses the push button 8, indicated by the arrow 33 in FIG. 5, the right hand flank of the end part 36*a* will meet the pin 38. Thus, depression of the push button 8 will have the effect of displacing the pivoted member 36 to the right, so that its end part 36*a* will engage the flat edge 39*a* of the rocking plate 39. The pin 43 carried by the end part 39*c* of the rocking plate 39 then imparts rocking movement to the further rocking plate 44 so that the end part 44*c* of the latter raises the spring 46 which disengages the chronographic gear train between the minute wheel 12 and a boss 52 (FIG. 4) of the stopwatch minute wheel. A projection 44*e* on the rocking plate 44 causes a spring 40 to engage a contact stud 49. Moreover, the end part 44*b* of the rocking plate 44 acts against a heart-shaped member 55 carried by the arbor of the stopwatch hour wheel 22. The stopwatch hour hand 6 is thus returned to zero. A further end part 39*b* of the rocking plate 39 acts on a further heart-shaped member 50 carried by the arbor of the stopwatch minute wheel 21. Consequently, the stopwatch minute hand 5 is also returned to zero. A further end part 44*d* of the rocking plate 44 acts against yet another heart-shaped member 51 which ensures the return to zero of the stopwatch second hand 4.

The illustrative electrical circuit (FIG. 6) comprises a frequency divider portion which serves for generating pulses of the various different frequencies which are necessary for the remainder of the circuit to operate. This part comprises an oscillator 61 and divider circuits 62, 63 and 66. The oscillator 61 feeds the divider 62 with pulses at a frequency of 32768 Hz. This divider 62 transmits via its output connection 62*f* pulses at a frequency of 1 Hz to the divide-by-6 frequency divider 63. The manner in which the frequency divider 63 operates will be described later: it transmits, however, from its output connection 63*a* to the other parts of the circuit pulses having a frequency of 1/6 Hz, i.e. ten pulses per minute.

Figure 7:
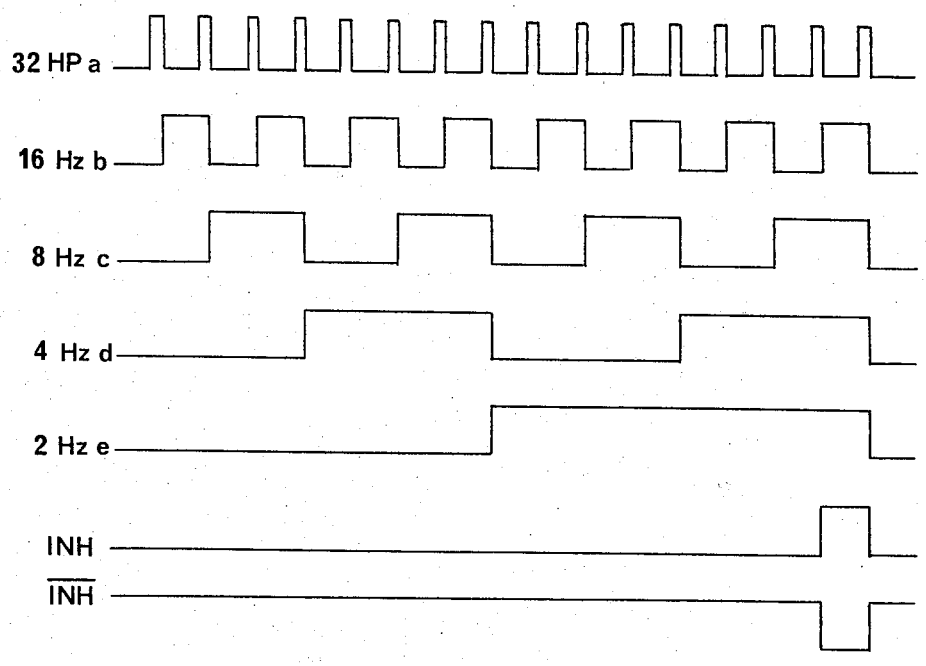
FIG. 7 illustrates diagrammatically the form of the pulses required for the operation of the watch.

The output connections 62*b, c, d* and *e* of the divider 62, which transmit pulses of 16 Hz, 8 Hz, 4 Hz and 2 Hz respectively, are connected to a NAND gate 64 which provides at its output an inhibiting signal INH. The form of this signal can easily be appreciated from the diagram of FIG. 7 which shows how the pulses 64*a* to 64*e* of 16 Hz, 8 Hz, 4 Hz, and 2 Hz respectively are combined to produce the INH signal at the output of the gate 64, as a short pulse with a repetition rate of 2 Hz. This signal is transmitted to one input of an AND gate 65. The other input of the NAND gate 64 has transmitted to it from the output 62*a* of the divider 62 a signal of 32 Hz. The combination of these two signals produces a pulsating signal with a mean frequency of 30 Hz at the output of the AND gate 65.

The frequency of the 30 Hz pulsating signal is divided by 3 in the circuit 66. At the input of this circuit there is an AND gate 67 which is connected to the output of the AND gate 65. The output of the AND gate 67 is connected to the input T of a toggle flip-flop 68, the output Q of which feeds an AND gate 69. The other input connection of the gate 69 is connected to the output of the AND gate 65. The output of the gate 69 is connected to the output of the AND gate 65. The output of the gate 69 is connected via an OR gate 70 to the input T of a second toggle flip-flop 71. This latter has one of its output Q connected to one input of an AND gate 72, the other input of which is directly connected to the output of the gate 65. The output of this gate 72 is connected via the OR gate 65. The output of this gate 72 is connected via the OR gate 70 to the input T of the flip-flop 71.

The manner in which the circuit 66 operates is illustrated in the following table:

| Input AND 67 | Outputs Flip-Flop 68 | Input AND 69 | Outputs Flip-Flop 71 | Input AND 72 | Output 10 pulses/sec 10 Hz |
|---|---|---|---|---|---|
| 1 | Q 0 | 1 | Q 0 | 1 | 0 |
| 1 | Q 1 | 0 | Q 1 | 0 | |
| 1 | Q 1 | 1 | Q 0 | 1 | 0 |
| 1 | Q 0 | 1 | Q 1 | 0 | |
| 1 | Q 0 | 1 | Q 1 | 1 | 1 |
| 0 | Q 1 | 0 | Q 0 | 1 | |
| 1 | Q 0 | 1 | Q 0 | 1 | 0 |
| 1 | Q 1 | 0 | Q 1 | 0 | |

Initially, each of the two flip-flops, which change over from one stable state to the other when the falling edge of an input pulse is reached, gives a 1 output at the Q output thereof. In response to each pulse, a logic signal 1 appears at the first inputs of the AND gates 67, 69 and 72. Since the second input of the AND gate 72 is in the same state as the output Q of the gate 71, namely 0, the AND gate 72 is closed and no pulse appears at the output 72*g* of the circuit 66. At the end of the first pulse, the flip-flop 68 changes state and a 1 appears at its output connection Q.

With the second pulse, each of the AND gates 67 and 68 has a 1 at each of its two inputs. The AND gate 72 has a 0 at its second input connection, since the flip-flop 71 has a 0 at its output connection Q. The AND gate 72 remains closed, so that no signal reaches the output 72*g* of the circuit 66. At the end of the pulse, the flip-flops 68 and 71 change state.

With the third pulse, each of the AND gates 67 and 69 has a 0 and a 1 at its inputs The AND gate 72, however, has a 1 at each of its two inputs and this gate being open, the third pulse passes through it and appears at the output 72*g*. Thus, the circuit 66 allows only one in three pulses to pass through it and operates effectively as a divider by three. The falling edge of this third pulse causes the flip-flop 71 to change state so that a 1 appears at its output Q. The flip-flop 68 remains in its initial state, the situation at the input connections of the AND gates 67, 69 and 72 being the same as that which existed before the first pulse. The cycle of operations is then repeated.

The circuit 63 which divides by six is based on the same principle. It comprises, however, an additional stage of a kind known per se which effects a division by 2.

The frequency dividing portions of the circuit thus provide pulses having a frequency of 1/6 Hz at the output 63*a*, pulses having a frequency of 10 Hz (10 HP) at the output 72*g* and pulses of 32 Hz (32HP) at the output 62*g*.

The main part of the electronic circuit comprises elements which are common to both the mechanical part and the electrical part of the watch. These are the motor 9 of the timepiece mechanism, the motor 15 of the stopwatch mechanism and the two sets of contacts 47, 48 and 40, 49 which are operated by the mechanical push buttons 7 and 8 respectively. The contacts 40 and 49 constitute the input of the zero resetting portion of the circuit. This portion of the circuit is grounded via a resistance 73 and is connected to two OR gates 74 and 75, which receive 0 inputs except when the contacts 40, 49 are closed. The second input of each of these OR gates is connected to a reset line 90, the operation of which will be described later. The output of the OR gate 72 is connected to the reset input R of a divider-by-10 counter 78. The output of the OR gate 75 is connected to the reset input R of a flip-flop 76. The output 72*g* of the circuit 66, which delivers 10 pulses per second (10 HP), is connected to a first input 77*g* of an AND gate 77 the second input of which is connected to the Q output of a flip-flop 76. The output of this AND gate 77 is connected to the counter 78 which delivers pulses at the rate of one pulse per second (1 Hz) to a control circuit 79 which supplies electric current to the motor 15.

The input via the contacts 40, 49 is also connected to one of the inputs of a NOR gate 91 which forms with another NOR gate 92 a memory circuit (latch). The output of the NOR gate 91 is connected to one of the inputs of an AND gate 94, as well as to one of the inputs of the NOR gate 92. A second input of the NOR gate 91 is connected to the reset line 90, while a third input thereof is connected to the output of the NOR gate 92. The second input of this gate 92 is connected to the contacts 47 and 48 forming the input to the START/-STOP portion of the circuit. This input is grounded via a resistance 80 and is also connected to an input D of a flip-flop 81. The latter has its Q output connected to the input T of the flip-flop 76, the Q output (RUN) of which is connected to the second input of the AND gate 77. The Q output (STOP) of the flip-flop 76 is connected to the second input of the AND gate 94. The CL input of the flip-flop 81 is connected to an input terminal 95 supplied with pulsating electric current at 32 pulses per second (32 HP) from the output terminal 62*g* of the frequency divider 62.

The output of the gate 94 is connected to the first input of an AND gate 82 and via an inverter 96 to the first input of an AND gate 97. The other inputs of the AND gate 82 are connected to outputs which represent the state B of the counter 78. The other inputs of the AND gate 97 are connected to outputs which represent the state C of another divide-by-ten counter 98, the input 98*g* of which is fed from the output 63*a* of the frequency divider 63 which emits signals having a frequency of 1/6 Hz. The output 98*b* of the counter 98 delivers pulses having a frequency of 1/60 Hz, i.e., 1 pulse per minute (1 MINP). The gates 82 and 97 actually represent a plurality of gates operated in parallel and their outputs are connected to the inputs of an OR gate 99, actually a plurality of OR gates, one for each bit of B and C.

An input terminal 100 receiving the 1 pulse per minute signal (1 MINP) from the output 98*b* of the counter 98 is connected to the set input S of a flip-flop 83 via an AND gate 101. The other input of the AND gate 101 is connected to the terminal 100 via a delay line composed of inverters 102, 103 and 104 connected in series and capacitors 105 and 106 at the outputs of the inverters 102 and 103. The effect of the AND gate 101 and of the delay line is to shorten the duration of the 1 pulse per minute (1 MINP) signal which is present at the S input of the flip-flop 83. The Q output thereof is connected to one of the inputs of an AND gate 87. The second inputs of the AND gates 85 and 87 receive signal of 32 pulses per second (32 HP) from the terminal 95. The output of the AND gate 85 is connected to the UP input I of a divide-by-10 UP-DOWN counter 86. The output of the AND gate 87 is connected to the DOWN input D of the counter 86. The output C of this counter 86 is connected to the input T of the flip-flop 83. The outputs A of the counter 86 and E of the OR gate 99 are connected to the two input ports respectively of a comparator 88. The output A>E of this comparator 88 is connected to the third input of the AND gate 87. The output A<E of the same comparator is connected via the OR gate 84 to one of the inputs of the AND gate 85. The outputs of the AND gates 85 and 87 are connected to a pulse forming circuit 89 for the motor 9.

A circuit, composed of a resistance 107 connected to an inverter 108 the input of which is earthed via a capacitor 109, is connected to the reset line 90. The function of this circuit 107–109 is to transmit a reset pulse to various components of the main circuit, when a cell is inserted. For this purpose, the reset line 90 is connected to the R inputs of the flip-flops 81, 83 and 76 (in the case of the last mentioned flip-flop 76 via the OR gate 75). The reset line 90 is also connected to the R inputs of the counters 63, 78, 86 and 98 and to the NOR gate 91. The input terminal 110 of this reset circuit is connected to the positive pole of the cell.

The manner in which the timepiece movement of the watch operates is as follows. When the cell is fitted and connected all the counters are set at zero and all the flip-flops are changed over to the state Q=1. The reset pulse applied to the NOR gate 91 causes a logical 0 to appear at the respective input of the AND gate 94, causing the 0 output to appear at the output of the latter and, due to the inverter 96, a 1 output to appear at the first input of the AND gate 97.

Every 6 seconds, a pulse of 1/6 Hz delivered by the frequency divider 63 enters the counter 98 via the input 98*g* of the latter. The condition C of this counter 98 is transferred to one of the inputs of the AND gate 97. Since a 1 input is present at the control input of this gate 97, this condition C is transferred to the input of the OR gate 99.

The condition E of the output of this gate 99 (E being the same as either C or B which are the states of the outputs of the counters 78 and 98 respectively) is transferred to one of the input ports of the comparator 88. The latter compares the condition A as the output of the counter 86 with the condition E at the output of the OR gate 99. A logical 1 appears at the output connections A>E or A<E when the conditions indicated by these inequalities exist. When the first pulse of 1/6 Hz is counted by the counter 98, the output E becomes 1 and, A being at 0, a logical 1 emanating from the output connection A<E and passing through the OR gate 84 appears at the first input of the gate 85. This allows a pulse of 32 pulses per second (32 HP) to be transmitted from the input 95. This pulse operates via the forming circuit 89 so as to cause the shaft of the motor 9 to advance by one step. This step of the motor causes the tenths of a second or small seconds hand 4 to complete 1/10 of a turn. By the intermediary of the gear train, the minute hand 2 advances a 1/600 of a turn, while the hour hand 1, driven by the minute wheel 13 advances 1/36000 of a turn.

The pulse emitted by the gate 85 increments the counter 86 via the input I of the latter so that the state A of the counter becomes 1. A becomes equal to E and a 0 appears at the input of the AND gate 85, causing the latter to close. The shaft of the motor 9 therefore remains stationary. Six seconds later, a second pulse reaches the input 98*a* of the counter 98. The state E at the output of the OR gate 99 becomes 2 and is applied to the comparator 88. Since A, the state of the counter 86 is equal to 1, the condition A<E is obtained and a logical 1 appears at the second input of the AND gate 85 allowing the passage through the latter of the signal having a frequency of 32 pulses per second (32 HP), which signal causes the shaft of the motor 9 to advance one step and increments the counter 86 by 1. The state A of the counter is increased to 2, with the result that the two output connections A>E and A<E of the comparator 88 become zero and the gates 85 and 87 are closed. The motor 9 thus remains at rest.

Thus, every six seconds, the shaft of the motor 9 rotates through one step and, by means of the gear train, drives the hands 1, 2 and 3 in the manner described above.

With the sixth pulse, the state C of the counter 98 becomes 0. This 0 is transferred to the apropriate input port of the comparator 88. It is compared with the state A of the counter 86 which was increased to 9 during the preceding pulse. The condition A E is thus realized and a logical 1 is transmitted to the corresponding input of the AND gate 87. However, the counter 98, when the tenth pulse is produced, transmits a one pulse per minute (1 MINP) pulse via its output 98*b* to the input 100. On reaching the S input of the flip-flop 83, the 1 MINP pulse produces a 1 at the Q output and a 0 at the Q output of this flip-flop, thereby closing the AND gate 87 and allowing a pulse to pass through the AND gate 85. The shaft of the motor 9 now completes its tenth advance step. The small second hand 3 has thus completed one turn and the minute hand has advanced 1/60 of a turn. The counter 86 is incremented and passes to zero. A is thus equal to E and a 0 appears at each of the two outputs of the comparator 88 and the AND gate 87 is closed. When the counter 86 passes to zero, it transmits a pulse from its output C to the input T of the flip-flop 83, causing the latter to undergo a change state at its Q output so that the AND gate 85 is closed. The shaft of the motor 9 is now stopped. The initial condition which obtained at the commencement of the first pulse is thus re-established.

It must be pointed out that the one pulse per minute (1 MINP) pulse, having been shortened by the circuit comprising the inverters 102 and 104, the capacitors 105 and 106 and the AND gate 101, disappears from the S input of the flip-flop 83 before the pulse from the output C of the counter 86 appears at the T input of the flip-flop 83.

The chronographic mechanism operates as follows:

The push button 7 is depressed closing the contacts 47, 48 and causing a positive voltage to appear at the D input of the flip-flop 81. A each 32 Hz pulse is applied to the input CL of the flip-flop 81, the Q output assumes the inverse state of the D input. Thus, at the end of the first pulse at the rate of 32 pulses per second (32 HP) following the operation of the push button 7, this Q output passes to zero. The logical 1 which was present at the T input of the flip-flop 76 gives way to a 0 whereby the flip-flop 76 is caused to change state so that its Q output is set to 1. This 1 is transmitted to the second input of the AND gate 77. This gate being open, pulses at the rate of 10 pulses per second (10 HP) issuing from the output 72*g* of the frequency-dividing circuit are applied to the input of the counter 78. With each sequence of ten pulses, the counter 78 emits a 1 HC control pulse to the pulse forming circuit 79 of the motor 15. With each pulse the shaft of the motor 15 advances one step and transmits its rotation via the gear train to the stopwatch second hand 4, minute hand 5 and hour hand 6. During the time-measuring operation, the timepiece mechanism continues to operate as described earlier. A second depression of the push button 7 causes a positive voltage to appear at the D input D of the flip-flop 81 so that the Q output thereof switches to zero. This has the effect of causing the flip-flop 79 to change state: a logical 1 appears at its Q output and a 0 at its Q output. This 0 closes the AND gate 77, the 10 pulses per second (10 HP) signal is cut off, the counter 78 ceases to count and, since the motor 15 receives no further pulses, the shaft thereof stops.

The stopwatch second hand 4 is stopped at the second preceding the end of the time period being measured. The additional tenths of seconds are available in the counter 78 as the state B thereof. Since the closing of the contacts 47, 48 by means of the two NOR gates 91 and 92 causes the first input of the AND gate 94 to change over to a 1 and the second input of this gate is also at 1, this being the state of the Q output of the flip-flop 76, a 1 is applied to the input of the AND gate 82 and, by means of the inverter 86, a 0 is applied to the input of the AND gate 97. This opens the gate 82 and closes the gate 97. The state B of the counter 78, passing through the AND gate 82 and through the OR gate 99 where it becomes the state E, is applied to the comparator 88. This state E is compared with the state A of the counter 86. If A<E, and the AND gate 85 is opened and the motor 9 receives as many forward driving pulses as there are units of difference between A and E. If A>E, the AND gate 87 is opened and the motor 9 receives as many rearward driving pulses as there are units of difference between E and A. These 32 pulses per second (32 HP) driving pulses drive the small or tenths of chronometric time hand 3 and cause it to indicate tenths of a second. Thus, when the chronographic mechanism is stopped, the chronometric time second hand 4 indicates the second, the tenths of chronometric time hand 3 indicates the tenth of a second and the other specific chronographic hands 5 and 6 indicate the chronometric minutes and hours respectively.

The manner in which the chronographic mechanism operates when it is stopped but not reset to zero is as follows:

After the timing operation, the tenths of a second hand 3 indicates a number between 0 and 9 which corresponds to the states A and B of the counters 86 and 78.

At the end of the minute following the timing operation, the minute pulse applid to the S input of the flip-flop 83 produces a 1 output at the Q output. The state of this output is transmitted to the first input of the AND gate 85 and opens the latter to allow the passage through it of the pulses at a frequency of 32 pulses per second (32 HP) which cause the motor shaft to advance and increment the counter 86. The state A of the latter increases up to 9 and then, in response to the next following pulse, passes to zero and its output C transmits a pulse to the T input T of the flip-flop 83, causing the latter to change its state. This causes a 1 to be applied to the first input of the AND gate 87, but at the same time the second input is set to zero by a 0 emitted from the output connection A>E of the comparator 88. At the same time, the output A<E of this comparator 88 transmits a 1 to the input of the AND gate 85, keeping the latter open while the successive pulses at a frequency of 32 pulses per second (32 HP) increment the counter 86 until the state A=E is again obtained. At the same time, the shaft of the motor 9, rotating at 32 steps per second, advances the hand 3 until it indicates the value E or the number of tenths of a chronometric second.

If the chronometric time is a whole number of seconds and the number of tenths of a second is therefore zero, the minute pulse, which opens the gate 85 in the same manner as before, enables the counter 86 to be incremented until it returns to zero. The state A=E having been established, the two AND gates 85 and 87 will be closed and the motor 9 which will have received ten pulses will be stopped after having effected about one revolution of the hand 3.

Thus, at the end of each minute, the tenths-of-a-second hand 3 rapidly completes one revolution and through the gear train causes the minute hand 2 to jump forward 1/60 of a revolution. Consequently the progression of the watch movement, when the chronographic mechanism is stopped but not reset to zero, is slightly different from the normal progression of the timepiece movement. The minute hand 2 in fact advances by a step of one minute at the end of each minute and at the same time the hand 3 completes a revolution in order to return to its starting point and to indicate the chronometric tenth of a second, taking 0.3 seconds to do this.

A further depression of the push button 7 causes the chronographic mechanism to restart and a second depression causes it to stop.

Depression of the push button 8 (which the chronographic mechanism stopped) closes the contacts 40, 49 and sets the counter 78 to zero by the resulting pulse acting on the R input thereof. The same pulse, inverted by the NOR gate 91 closes the AND gate 94 and hence closes the AND gate 82 thereby opening the AND gate 87. The timepiece mode of the watch is now re-established. The 1/6 Hz pulses, entering at 98*a*, increment the counter 98. The comparator 88 closes the gate 85 if the condition E<A prevails (A being at this movement the value indicated by the tenths of a second hand 3), but as soon as the condition A<E is established the motor receives pulses every six seconds, the hand 3 again indicates the relevant second and once again becomes a small second hand. The movement now continues to function in the watch mode as described previously.

The chronographic watch described may also have an improved resetting to zero system with a recall function. Thus, as has been shown previously, when the user depresses the push button 8, indicated in FIG. 5 by the arrow 33, the pin 38 engages the left flank of the end part 31*a* of the selector lever 31. Consequently, the end part 36*a* of the pivoted member 36 acts against a spring 57 which closes an electrical contact against a contact stud 58.

Figure 8:
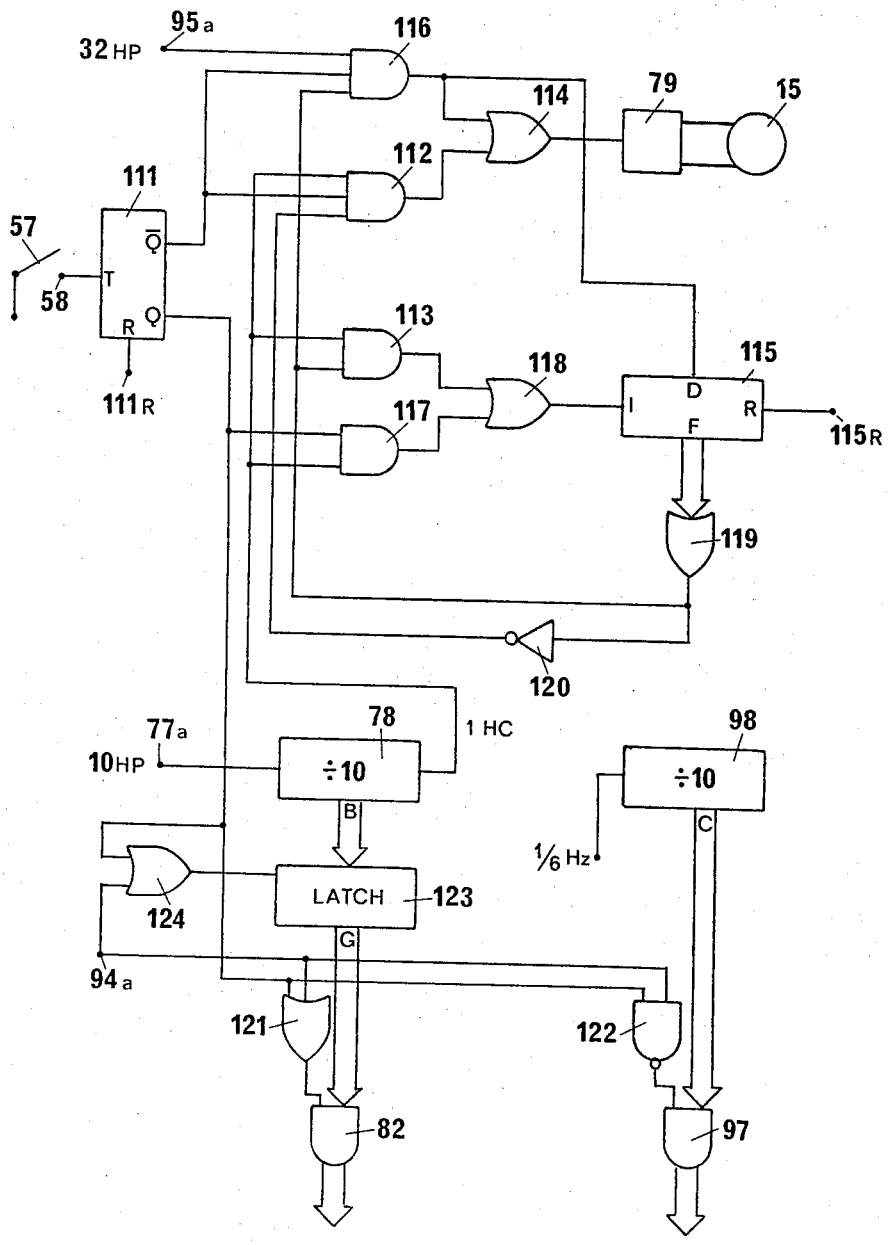
FIG. 8 is a diagram of an illustrative electronic circuit which enables a recall mechanism to be operated.

The circuit shown in FIG. 8 makes use of the switch comprising the spring 57 and the stud 58. This switch is connected to a toggle flip-flop 111 and the Q output of which is connected to an OR gate 121, a NAND gate 122 and via an OR gate 124 to a memory latch 123. The Q output of the flip-flop 111 is connected to inputs of an AND gate 112 and an AND gate 116. The second input of the AND gate 112 is fed with 1 Hz pulses 1 HC by the divide-by-ten counter 78 of FIG. 6. This counter 78 receives a signal of ten pulses per second (10 HP) from the output 77*a* of the AND gate 77 already referred to. The second input of the AND gate 116 receives a signal of 32 pulses per second (32 HP) from a terminal 95*a* which is connected to the output 62*g* of the circuit 62 that supplies pulses at various different frequencies. The outputs of the AND gates 116 and 112 are connected through an OR gate 114 to the control circuit 79, already described, of the motor 15 of the stopwatch movement of the watch. The outputs of the AND gates 113 and 117 are connected to the UP input I of an UP-DOWN counter 115. The DOWN input D of the counter 115 is connected to the output of the AND gate 116. The outputs F of the counter 115 are connected to the inputs of an OR gate 119 so that the output of this gate goes to 1 wherever the contents of the counter are other than zero. The output of the gate 119 is connected to second and third inputs of the AND gates 113 and 116 respectively. The output of the gate 119 is also connected via an inverter 120 to a third input of the AND gate 112.

The output 94*a* of the AND gate 94 (FIG. 6), which gives the STOP signal of the stopwatch mechanism, is connected via an OR gate 124 to the latch 123 and to second inputs of the OR gate 121 and the NAND gate 122. The output of the OR gate 121 and the outputs giving the state G of the latch 123 are connected to the inputs of the AND gate 82. The output of the NAND gate 122 and the outputs giving the state C of the counter 98 are connected to the inputs of the AND gate 97. These two AND gates 82 and 97 are connected in the same manner as in FIG. 6 to the OR gate 99 and thus to the comparator 88.

Figure 6:
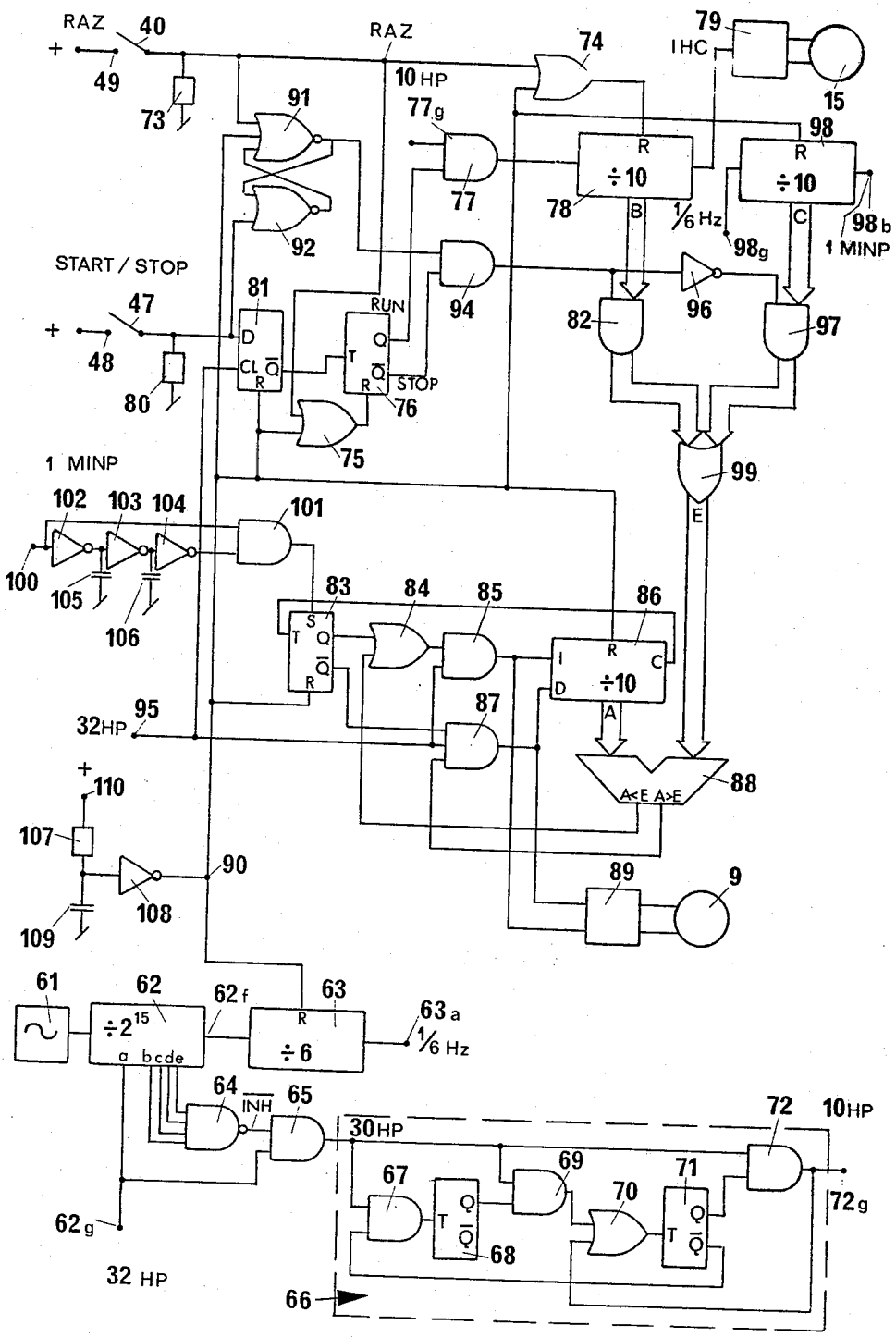
FIG. 6 is a diagram of the electronic circuit for actuating the mechanical elements of the watch according to this illustrative embodiment of the invention.

The reset inputs 111R of the flip-flop 111 and 115R of the counter 115 are connected to the reset line 90 and to the switch comprising the contacts 40, 49 at the input of the reset to zero circuit shown in FIG. 6.

The chronographic watch with resetting means operates as follows:

When running normally, with the stopwatch mechanism engaged, the ten pulses per second (10 HP) signal enters the counter 78 which transmits a signal of 1 HC to the input of the gate 112. The flip-flop 111, which has received a reset pulse when the battery was inserted, has at its Q output a logical 1 which is transmitted to the second input of the gate 112. The counter 115 is also set to zero and its state F is zero, which through the inverter 120 applies a 1 to one input of the gate 112. The gate 112 allows a signal of 1 HC to pass through it, which signal, passing via the OR gate 114 and the pulse-forming circuit 79 of the motor 15, causes the shaft of the motor 15 to rotate forward at a rate of 1 step per second.

As in the case when the basic stopwatch mechanism is in use, the output 94*a* (STOP) is at zero causing the gate 82 to be closed and one of the inputs of the NAND gate 122 to be set at 0. The other input of the gate 122 being set at zero by the Q output of the flip-flop 111, the output of the gate 122 is at 1 and consequently the AND gate 97 is open. The indication is effected in the same way as in the time measured by the timepiece mechanism of the watch, the small second hand 3 advancing one step every six seconds. Depression of the reset to zero push button 8 causes the spring 57 to make contact with the contact stud 58. This causes the flip-flop 111 to change state, setting its Q output at 1 and its Q output at 0. This 0 closes the gate 112 so that the motor 15 stops and consequently also stops the stopwatch second hand 4 which indicates the seconds of time counted since the push button 8 was depressed. The pulse emanating from the Q output of the flip-flop 111 appears at the input of the latch 123 which memorizes the state B of the counter 78 at the moment when the push button 8 was depressed. This pulse also passes to the input of the NAND gate 122 which is thereby closed. The AND gate 82 is open, the AND gate 97 is closed, the state G of the latch 123 passes through the AND gate 82 and is indicated by the small second hand 3 in the manner described above for the basic chronograph when the stopwatch movement is stopped and the hands have not been reset to zero. The logical 1 at the Q output opens the gate 117 and the seconds which have elapsed after the push button 8 was depressed are stored in the counter 115 which they increment via the OR gate 118. It should be noted that, when the state F of the counter 115 becomes different from 0, the AND gate 113 is opened, as a result of which, after the second pulse following the depression of the push button 8, pulses have a frequency of 1 Hz arrive at the OR gate 118 from the outputs of the AND gates 113 and 117. Thus, the stopwatch hands are stopped, but the elapsing time is stored in the counter 115. A further depression of the push button 8 recloses the switch 57, 58 and causes the flip-flop 111 to change state giving a 1 at its Q output and a zero at its Q output. This zero has the effect of closing the AND gate 117, applying a zero to the input of the latch 123 and opening the NAND gate 122.

The small second hand 3 again advances one step every six seconds. The state F of the counter 115, being different from 0, causes a 1 to be transmitted to the third input of the gate 116. The second input of this gate 116 being in the same state as the Q output of the flip-flop 111, this gate is open and allows the signal of 32 pulses per second (32 HP) to pass through it. This signal causes the shaft of the motor 15 to rotate so that the second hand 4 advances at the rate of 32 steps per second. The hand 4 thus reproduces the indication of time stored in the counter 115. As each pulse enters the circuit of the pulseforming device 79 of the motor 15, the counter 115 is decremented via its DOWN input D. Since the state F of the counter 115 is 0, this last-mentioned 0 is transferred via the OR gate 119 to the input of the AND gate 116 which is thereby closed so that it interrupts the arrival of the 32 pulses per second (32 HP) pulses. However, by means of the inverter 120, this 0 opens the gate 112 which once again allows the 1 HC pulses to pass to the pulse forming circuit 79 of the motor 15, the shaft of which thereupon rotates at the rate of 1 step per minute. The shaft of the motor 15, and consequently the hand 4, regain their normal speed of one step per second as soon as the time stored in the counter 115 is recalled therefrom.

During the period of recall, the pulses of 1 HC are not lost but enter the counter 115 via the AND gate 113. A second depression of the START/STOP push button 7 stops the counting operation. In fact, the movable member 25 (FIG. 5) engages the part 28*d* of the cam 28. Consequently, contact between the contact stud 48 and the spring 47 is broken. The end part 30*a* of the spring 30 passes from the notch 28*c* to the notch 28*b*. In addition, the selector lever 31 becomes displaced so that, if the push button 8 is depressed, the right hand flank of the end part 36*a* cooperates with the pin 38. Thus, depression of the push button 8 causes the pivoted member 36 to be displaced to the right. Consequently, the spring 57 ceases to abut against the contact stud 58 and the resetting mechanism is no longer activated by the action on the push button 8. The resetting to zero of the hands of the chronographic mechanism is effected by the rocking plates 39 and 44. However, prior to this operation, the projection 44*e* of the rocking plate 44 will have caused the spring 40 to be brought into contact with the contact stud 49 whereby the counter 115 is reset to zero. The chronographic mechanism operates in the watch mode as described previously.

It would be possible, with the aid of a different set of parts responsive to the action of the push button 8 to depress the push button 7 only once when the resetting mechanism is activated, that is to say when the motor 15 is stopped the counter 115 (FIG. 8) will be incremented and will prevent the arrival of pulses at the counter 78 (FIG. 6). A further depression of the push button 8 will have the effect of emptying the counter 115 via the AND gate 116 and thus causing the shaft of the motor 15 to rotate at 32 steps per minute in order to cause the hand 4 and the small second or tenths of a second hand to indicate the time that has elapsed between the beginning of the timing operation and the second depression of the push button 7. This manipulation makes it possible for a timing operation to be effected a first time, for the result of this timing operation to be read, for a timing operation to be effected a second time and for the result to be indicated. This can easily be achieved with a chronograph of the type described by means of a slightly different arrangement of the parts which are responsive to the action of the push button 8.

While various preferred illustrative embodiments of the invention have been shown and described, it will be understood by those skilled in the art that other embodiments and modifications may be made within the principles of the present invention and within the scope of the appended claims.

What is claimed is:

1. A chronographic watch, comprising a timepiece mechanism and a stopwatch mechanism, these mechanisms comprising a first set of gear-driven hands for indicating the hour, minute and second; a second set of gear-driven hands for indicating the chronometric hour, the chronometric minute and the chronometric second; a frequency source delivering a low frequency signal, an intermediate frequency signal and a high frequency signal; a first motor supplied with the low frequency signal and driving the first set of hands so that they perform the function of timepiece hands; a second motor driving the second set of hands; a circuit including means responsive to an external operation to start and stop the stopwatch mechanism by supplying and ceasing to supply the second motor with pulses at the intermediate frequency, means for storing the fraction of a second of chronometric time in excess of the time indicated by the second hand of the second set of hands and control means responsive to the stopping of the stopwatch mechanism for supplying to the first motor a number of pulses of the said high frequency corresponding to the said fraction in such a manner that the said fraction will be indicated by means of the second hand of the first set of hands; and means for resetting the second set of hands to zero in response to an external operation.

2. A chronographic watch according to claim 1, wherein the control means is also responsive to stopping of the stopwatch mechanism to supply to the first motor, at the end of each minute, such a number of pulses of the said high frequency as is necessary to produce a complete revolution of the second hand of the first set of hands, so that the minute hand of the first set will be caused to advance one step.

3. A chronographic watch according to claim 1, wherein the said intermediate frequency is 1 Hz.

4. A chronographic watch according to claim 3, wherein the said low frequency is 1/16 Hz.

5. A chronographic watch according to claim 3 or 4, wherein the said high frequency is 32 Hz.

6. A chronographic watch according to claim 5, wherein the frequency source comprises an oscillator, a frequency divider fed by the oscillator and producing pulses of 32 Hz, 16 Hz, 4 Hz, 2 Hz and 1 Hz, a combining circuit connected to the frequency divider and producing pulses of 30 Hz, a divider which divides by 3 connected to the combining circuit and providing pulses of 10 Hz and a divider which divides by 6 connected to the 1 Hz output of the frequency divider and producing pulses of 1/6 Hz.

7. A chronographic watch according to any of claims 1 to 4, wherein the said storing means comprises a first counter and the control means comprises and UP-DOWN counter the state of which corresponds to the said fraction indicated by the second hand of the first set and a comparator which compares the state of the first counter with the state of the UP-DOWN counter.

8. A chronographic watch according to claim 7, wherein the first counter counts the 10 Hz pulses.

9. A chronographic watch according to any of claims 1 to 4, wherein the means for resetting the second set of hands to zero is mechanical.

10. A chronographic watch according to any of claims 1 to 4, further comprising means, responsive to the actuation of the stopwatch mechanism, for stopping the second set of hands and means, responsive to the action of the means for stopping the second set of hands, for indicating the period of time that has elapsed since the commencement of the time period measurement with the said second hand of the second set of hands and the second hand of the first set of hands, means for storing the period of time that has elapsed since the stopping of the second set of hands and activating means for producing and supplying pulses at the said high frequency to the second motor in such a manner as to accelerate the second set of hands and to cause the indication of the time that has elapsed since the commencement of the time-measuring operation to be restored to the hands of this set.

11. A chronographic watch according to claim 10, wherein the means for stopping the second set of hands and the said activating means are operable by the means for resetting the second set of hands to zero.

12. A chronographic watch according to claim 10, further comprising means, responsive to the means for stopping the second set of hands for completing stopping the stopwatch mechanism and engaging the said activating means in order to accelerate the second set of hands and to cause the indication of the time that has elaspsed since the commencement of the time-measuring operation to be restored to the hands of the second set.

13. A chronographic watch according to claim 10, wherein the said means for storing the time that has elapsed comprises a logic circuit arranged in such a manner as to increase the sum total counted by a second UP-DOWN counter by the pulses of said intermediate frequency.

14. A chronographic watch according to claim 13, wherein the sum total counted by the second UP-DOWN counter is decreased by the pulses which control the operation of the second motor.

* * * * *